United States Patent [19]

Sailor

[11] 4,430,830

[45] * Feb. 14, 1984

[54] DOOR OR WINDOW JAMB ASSEMBLY

[75] Inventor: Vernon R. Sailor, Elkhart, Ind.

[73] Assignee: Sailor Manufacturing Company, Elkhart, Ind.

[ * ] Notice: The portion of the term of this patent subsequent to May 25, 1999 has been disclaimed.

[21] Appl. No.: 284,557

[22] Filed: Jul. 20, 1981

Related U.S. Application Data

[63] Continuation-in-part of Ser. No. 171,731, Jul. 24, 1980, Pat. No. 4,330,972.

[51] Int. Cl.[3] ..... E06B 1/04

[52] U.S. Cl. ..... 52/211; 52/213; 49/504

[58] Field of Search ..... 52/211, 213; 49/504

[56] References Cited

U.S. PATENT DOCUMENTS

| | | | |
|---|---|---|---|
| 3,354,586 | 11/1967 | Den Besten | 49/504 |
| 3,694,961 | 10/1972 | Johnson | 49/504 X |
| 3,774,345 | 11/1973 | Cole et al. | 49/504 |
| 3,861,444 | 1/1975 | Portwood | 49/504 X |
| 3,875,713 | 4/1975 | Laborde | 52/213 X |
| 4,330,972 | 5/1982 | Sailor | 52/213 X |

*Primary Examiner*—Carl D. Friedman

*Attorney, Agent, or Firm*—James D. Hall

[57] ABSTRACT

A frame which is for mounting windows or pre-hung doors in openings of an existing structure and which includes an extruded metal or plastic outer frame, a wooden frame for the support of the extruded outer frame, fasteners which are used for attaching the outer frame at a window or door opening, and a molded cover which is secured to the outer frame and conceals the fasteners attaching the frame to the structure.

7 Claims, 7 Drawing Figures

DOOR OR WINDOW JAMB ASSEMBLY

CROSS-REFERENCE TO RELATED APPLICATION

This is a continuation-in-part of application Ser. No. 171,731, filed July 24, 1980 now U.S. Pat. No. 4,330,972.

SUMMARY OF THE INVENTION

This invention relates to a frame assembly used in fastening windows or pre-hung doors to an opening of an existing structure.

Heretofore the usual method for mounting a window or pre-hung door has been to drive fasteners through the side frame of the door or window and into the jamb of the structure. When a door or window is not properly positioned, the fasteners are removed and the door or window is reset. This creates mars on the frame or leaves holes that must be filled or covered to preserve the aesthetic appearance of the frame. This was necessary because the fastening devices were located in visible portions of the frame. Since the door and window frames of the prior art are usually from wood, they have to be painted and maintained to keep their appearance. Also, when resetting a frame made of wood, the wood often has a tendency to split as a result of drying or curing.

The door or window frame of this application includes an extruded outer frame which is formed to accommodate a wooden frame support member which fits into the outer frame. The outer frame is secured to the support member with screws or other means turned or driven into the support frame. The connected wooden support member and outer frame are fitted into an opening with attachment means such as screws turned through an anchor flange of the outer frame and into the jambs and header sides and top of the door or window opening. The screws are then covered by a strip decorative member which snaps into place between ridges in the anchor flange of the outer frame.

This construction accommodates the resetting of a door or window. The resetting can be easily accomplished by removing the decorative member and removing the fastening means driven through the anchor flange of the outer frame. Since the fastening means are covered by the decorative member when in place, there is no need to be concerned about visibly marring or defacing the frame when resetting the door or window. This method of attaching the frame also allows for easy removal of a door or window if it must be replaced. By making the outer frame of extruded metal or plastic material and the decorative member of vinyl or other molded material, the frame is essentially maintenance free.

Another advantage provided by this invention is that the production cost is less than the cost of producing an all-wood door or window frame. Also, the metal-wood or plastic-wood combination provides a frost barrier which is conducive to better insulation of the interior of the structure to which the door or window is attached.

Accordingly, it is an object of this invention to provide a novel frame for windows or pre-hung doors.

Another object of this invention is to provide a door or window frame which may be easily removed or adjusted.

It is another object of this invention to provide a door or window frame which has means hidden from sight for attaching it to the jambs of a wall.

Still another object of this invention is to provide a door or window frame which is essentially maintenance free.

Another object of this invention is to provide a door or window frame which provides a frost barrier as an inherent part of its construction.

Still another object of this invention is to provide a window frame which may accommodate many different styles of windows.

Further objects will become obvious upon a reading of the following description.

DESCRIPTION OF THE PREFERRED EMBODIMENTS

The preferred embodiments illustrated are not intended to be exhaustive nor to limit the invention to the precise forms disclosed. They are chosen and described in order to explain the principles of the invention and its applications and practical uses to thereby enable others skilled in the art to best utilize the invention.

The door frame assembly 8 of this invention, as shown in FIGS. 1–4, includes a three-sided outer frame 10, a corresponding wooden inner frame 12 and a decorative or cover member 14. A threshold of conventional design may be used with assembly 8.

Figure 1:
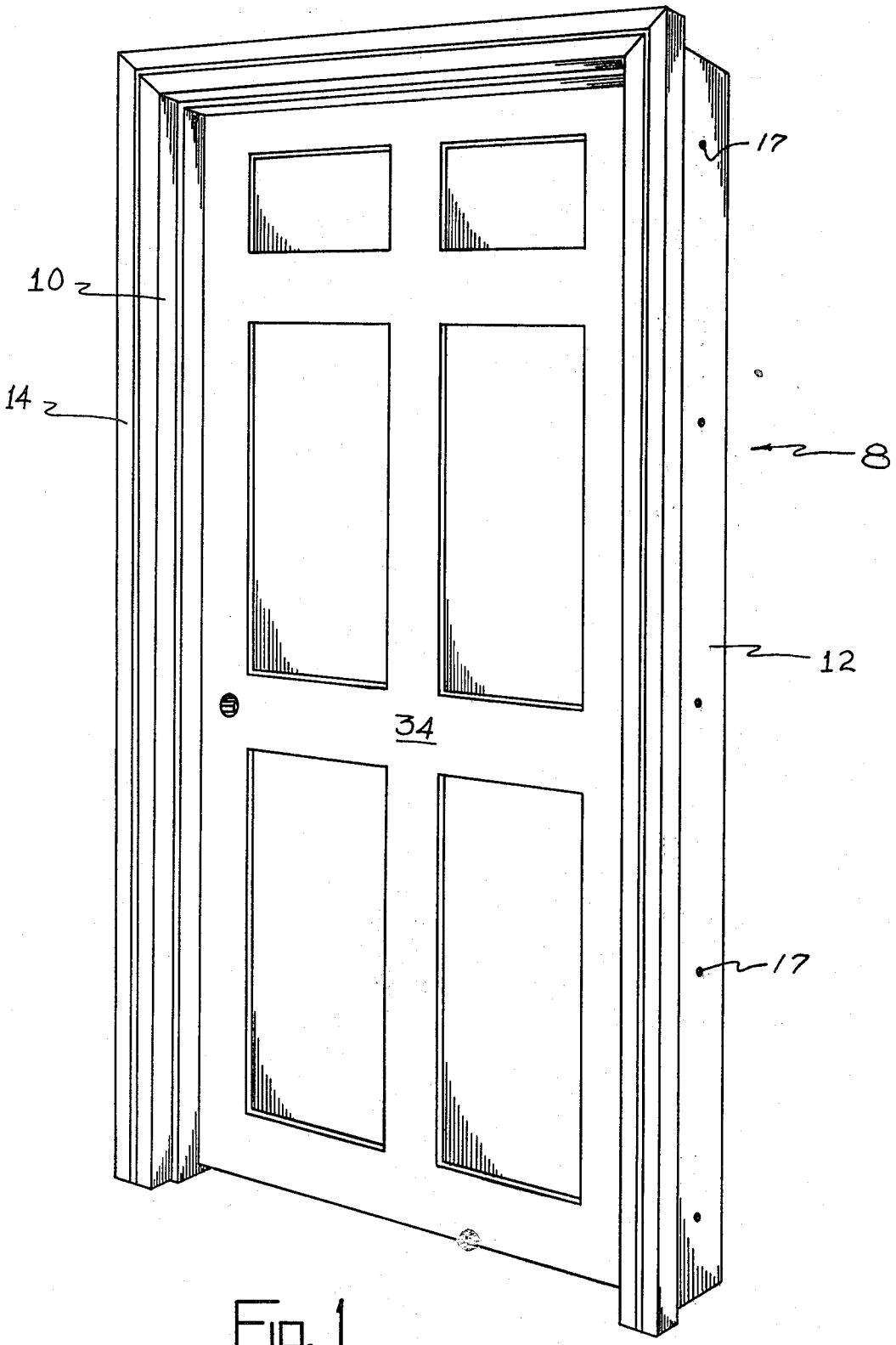
FIG. 1 is a perspective view of the door assembly.
Figure 2:
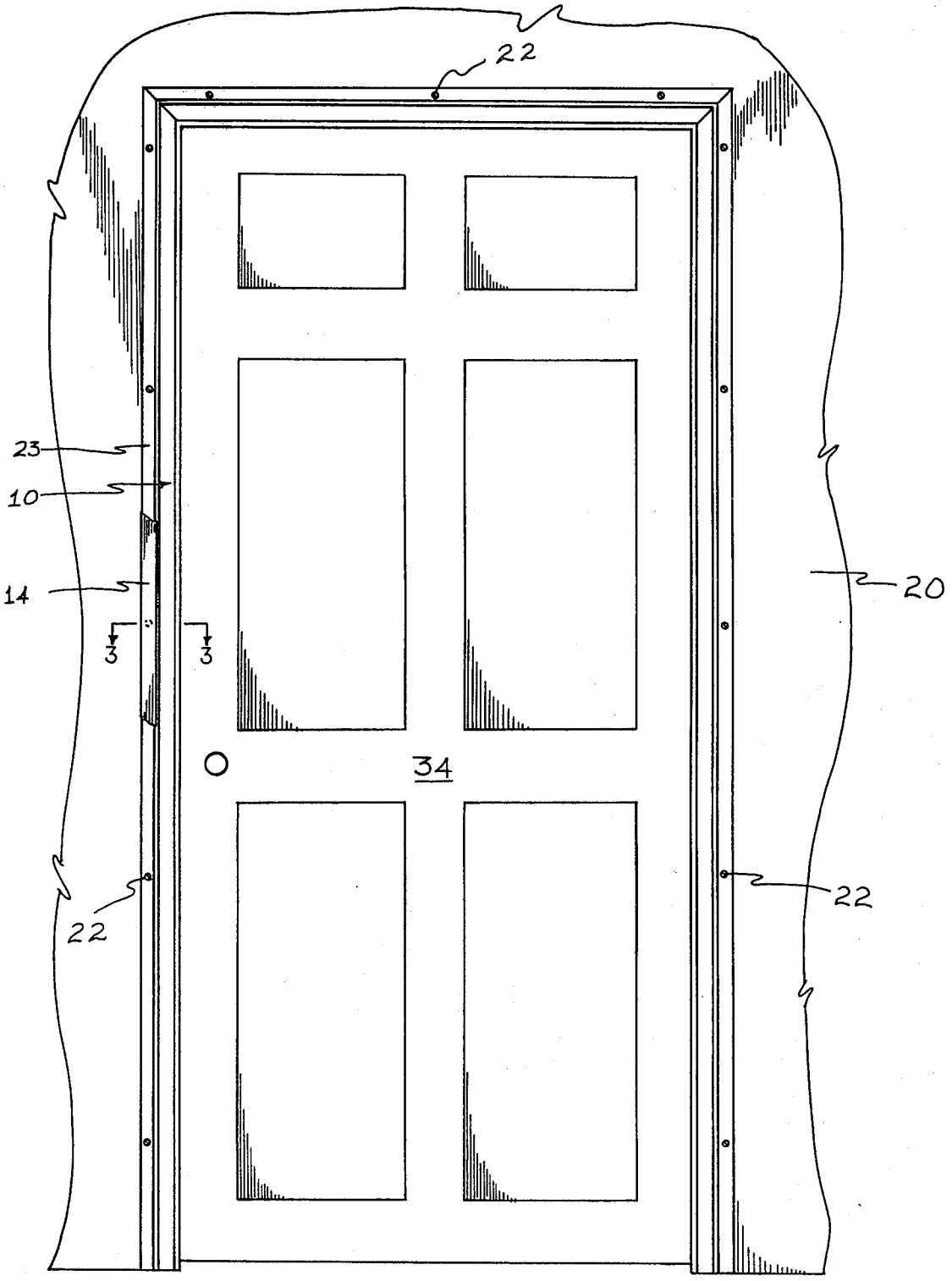
FIG. 2 is a front elevational view of the door assembly with a fragment of a decorative member illustrated therein.
Figure 4:
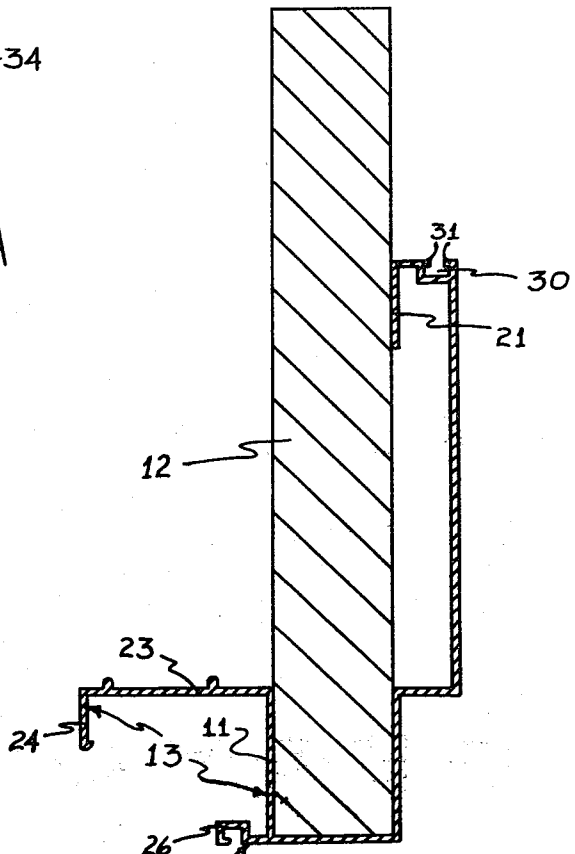
FIG. 4 is a sectional view of the metal door frame and wooden support frame.
Figure 3:
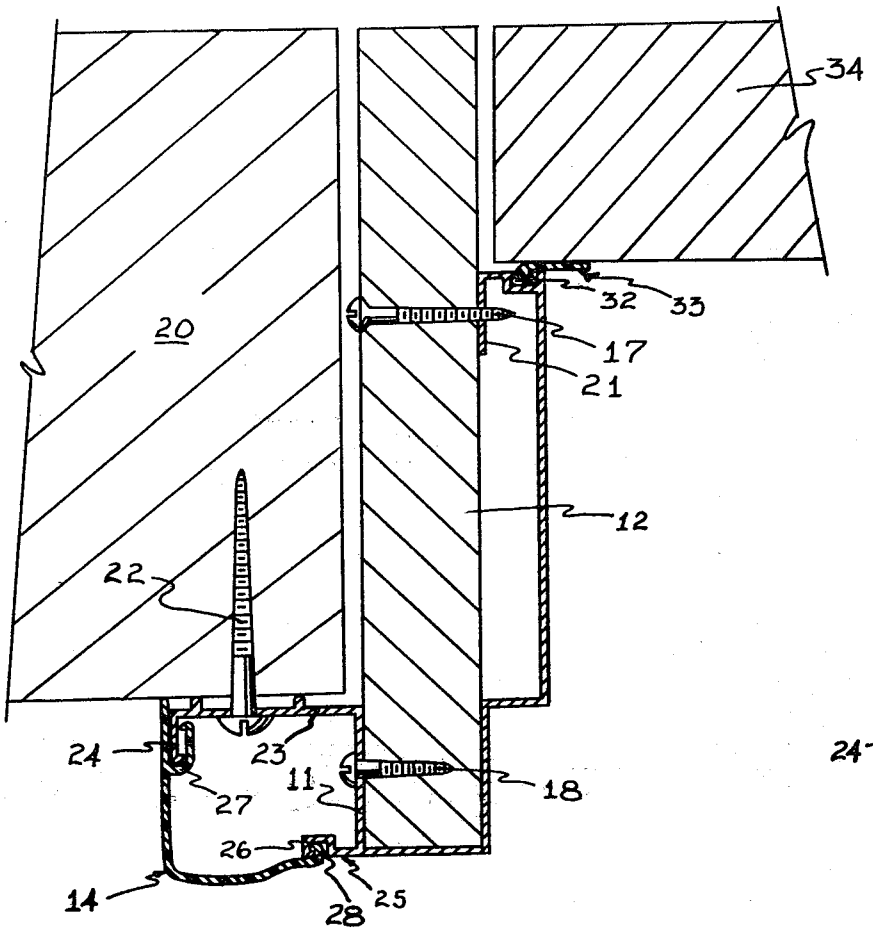
FIG. 3 is a sectional view taken along line 3—3 of FIG. 2.

The outer frame 10 is preferably made of an extruded material and is of the uniform cross section as shown in FIGS. 3 and 4. Outer frame 10 is configured to receive the inner frame 12 which fits snugly into it. Inner frame 12 is preferably secured to the outer frame 10 by screws 17 and 18 or other attachment means. Screws 17 are turned through inner frame 12 and anchor into inturned return flange 21 of the outer frame 10. Screws 18 are driven through one wall 11 of a U-shaped portion 13 of the outer frame 10 and are anchored in inner frame 12. Screws 17 and 18 remain hidden from view when the door frame assembly is in position against the existing wall structure 20 which defines the door opening.

The door frame assembly 8 is secured to the sides and top of the door opening in an existing structure 20 by use of screws 22 or other means turned through an outturned flange or wall 23 of portion 13 of the outer frame 10 and anchored in the existing structure 20. Wall 23 terminates in a longitudinal lip 24 which preferably extends perpendicularly outwardly from the margin thereof. A flange 25 projects substantially perpendicularly from wall 11 and preferably terminates in a groove part 26.

The walls 11 and 23 are covered by the decorative member 14 which is generally L-shaped. Decorative member 14 includes a longitudinal marginal U-shaped part 27 which fits around the lip 24 and an opposite longitudinal marginal hook part 28 which anchors in groove part 26. Decorative member 14 is retained in place by U-shaped margin 27 straddling lip 24 and the snap interlock of hook part 28 with groove 26, covering screws 22 turned into the underlying structure 20. When the door frame assembly is anchored to door opening structure 20 and decorative members 14 are applied, no means of attachment to the opening structure is visible. The frame assembly can be easily adjusted within the existing door opening by the simple removal and replacement of screws 22.

The inturned return flange 21 of the outer frame 10 provides a stop for the door 34 and is provided with a U-shaped longitudinal channel 30 whose mouth is defined by inturned ribs 31. Channel 30 receives with a snap fit a molded enlargement 32 of strip 33, preferably formed of rubber or other suitable flexible material, which is engaged by the margin of door 34 and serves as a seal or weather strip.

Figure 6:
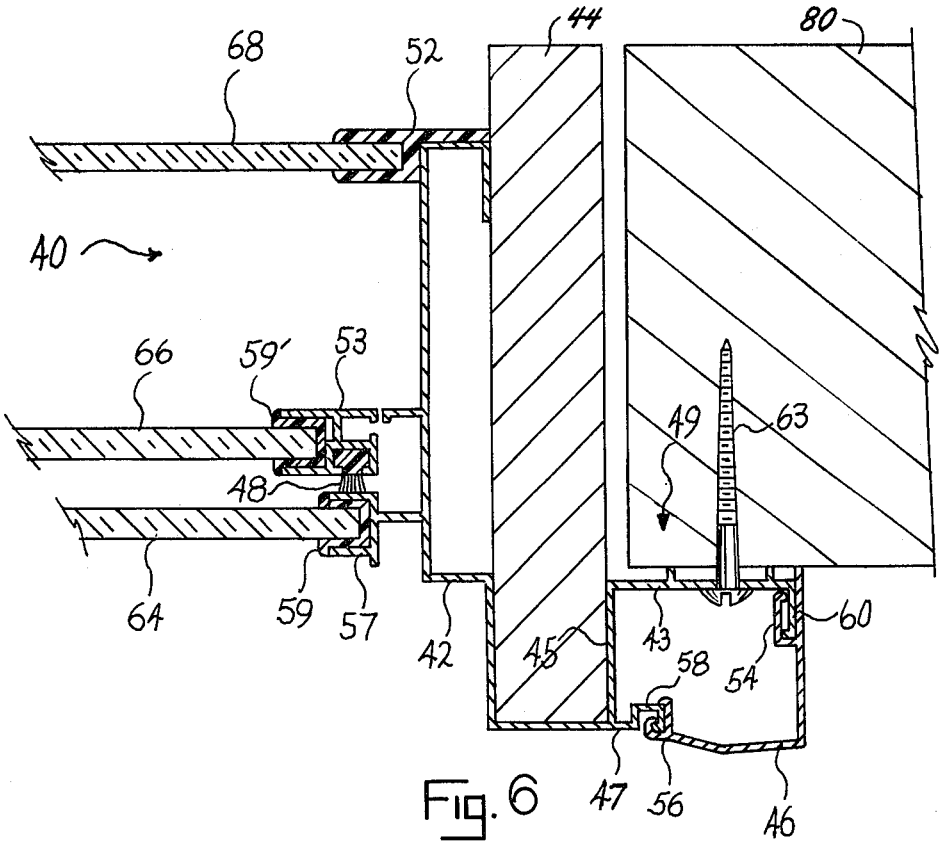
FIG. 6 is a fragmentary sectional view taken along line 6—6.
Figure 5:
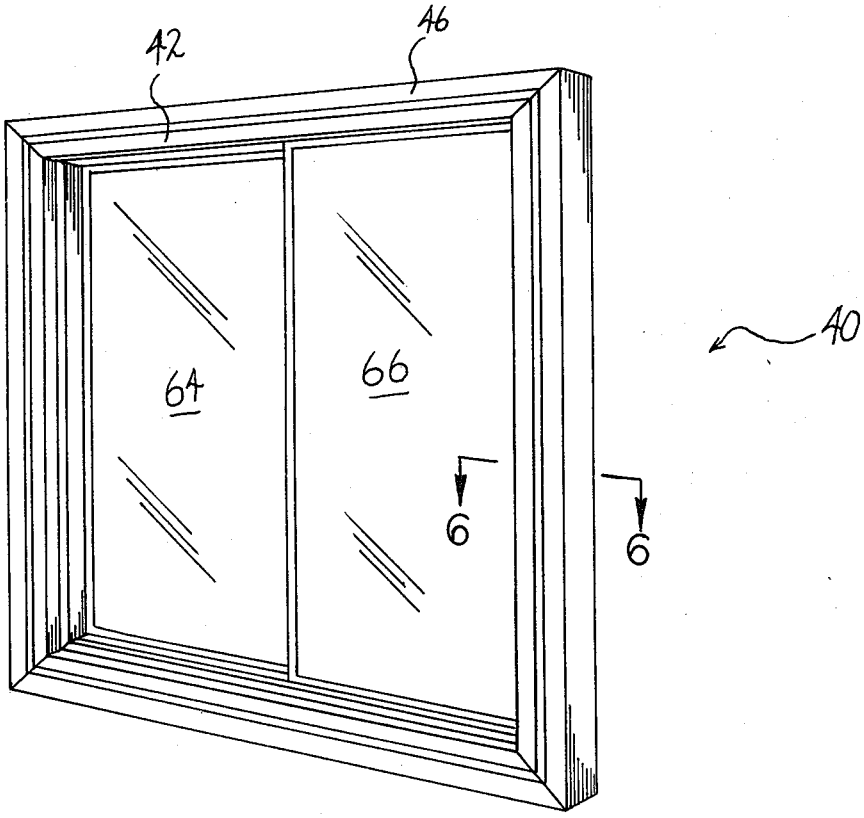
FIG. 5 is a perspective view of the window assembly.
Figure 7:
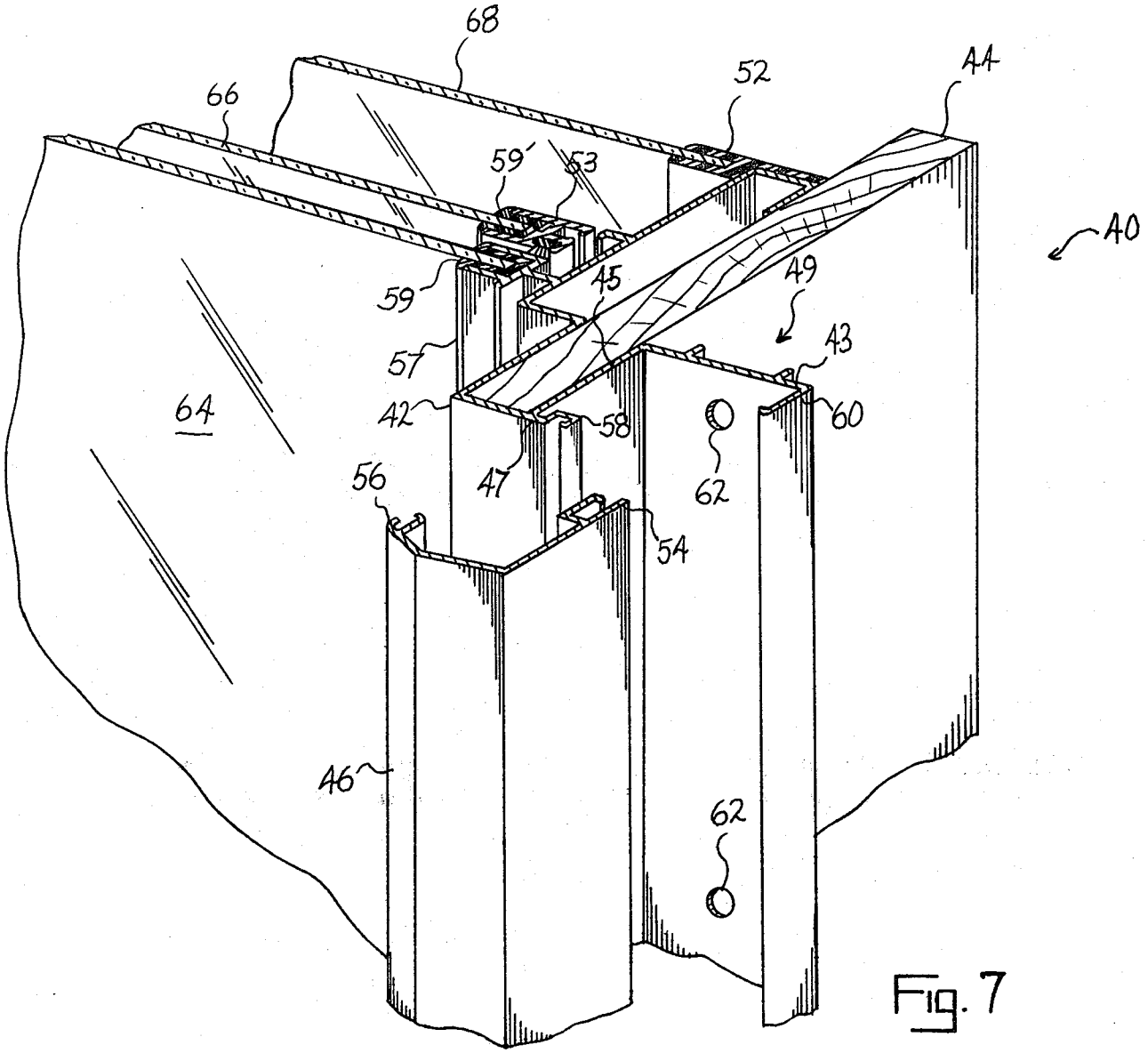
FIG. 7 is a front perspective view of the window assembly in sectionalized form with the cover member removed for purposes of illustration.

A second embodiment of this invention describes a window frame assembly 40 which is shown in FIGS. 5–7. Frame assembly 40 includes an outer frame member 42, inner frame member 44 and cover member 46. The outer frame 42 is made of extruded metal or plastic material and is configured to receive inner frame 44, which fits snugly into it.

Frame assembly 40 is secured to the sides of the window opening in underlying structure 80 by fasteners, such as screws 63. Screws 63 are turned through mounting holes 62 in wall 43 of outturned flange 49 and anchored in wall 80. Wall 43 terminates in a longitudinal lip 60 which preferably extends perpendicularly outward from the margin thereof. A flange 47 projects perpendicularly from wall 45 and terminates in a groove part 58.

Walls 43 and 45 are enclosed by a cover member 46 which is generally L-shaped. Cover member 46 includes a longitudinal marginal U-shaped part 54 which fits around lip 60 and an opposite marginal hook part 56 which attaches to groove part 58. Cover member 46 is retained in place by U-shaped part 54 straddling lip 60 and the interlock of hook part 56 with groove part 58 with screws 63 being hidden from view. Frame assembly 40 is easily adjusted within the opening by simple removal and replacement of screws 63.

Outer frame 42 provides for a longitudinal U-shaped channel part 57 which secures window glazing panel 64 in place by use of a gasket 59. A second window glazing panel 66 is configured to be set in preformed grooves which run horizontally along the top and bottom of frame assembly 40. Panel 66 is secured in channel part 53 within a gasket 59' and may be slid horizontally, relative to panel 64. Channel part 53 is configured to receive felt weather stripping member 48 providing an insulative function when panel 66 slides relative to panel 64. In addition, outer frame 42 is constructed to provide for a thermal barrier window 68 in periods of colder weather. Window 68 is fitted into a channel part 52 which is connected to outer frame 42.

It is to be understood that the above description of the glazing panels is merely for purposes of illustration, and is not intended to limit the structure defined therein. Frame assembly 40 may be adapted to accommodate other types of windows such as double hung, awning and casement windows.

It is understood that the invention is not to be limited to the above description but may be modified within the scope of the appended claims.

What I claim is:

1. A preconstructed frame assembly adapted for insertion into a door or window opening defined by an outlining wall structure, said frame assembly comprising an outer frame having spaced margins and including a U-shaped part at one of said frame margins, said U-shaped part terminating in an outturned wall, a wooden inner frame member, one edge of said inner frame member fitting into said outer frame U-shaped part with said outturned wall of the outer frame being located to project outwardly from the inner frame member, said inner frame member extending generally coextensively with said outer frame member between said frame margins, said frame member outturned wall and inner frame member adapted to overlie spaced portions of said wall structure defining said opening when said frame assembly is inserted into said opening, said frame member outturned wall constituting means for receiving fasteners anchored into said wall structure at said opening, a cover strip coextensive with said outer frame, means for connecting said cover strip to said outer frame over said outturned wall of said outer frame to cover said fasteners when anchored into said wall structure.

2. The frame assembly of claim 1 wherein said inner frame member extends beyond the opposite margin of said outer frame from said U-shaped part and is adapted to overlie a said portion of the wall structure to form an insulative function.

3. The frame assembly of claim 1 and an inturned return flange formed at the opposite margin of said outer frame from said U-shaped part thereof, said inner frame member contacting said outer frame inturned return flange.

4. The frame assembly of claim 3 wherein said inner frame member is secured to said outer frame member by use of second fasteners.

5. The frame assembly of claim 4, wherein said second fasteners extend through said inner frame member and into said outer frame inturned return flange so as to be positionable next to a said portion of the wall structure and under said outer frame, whereby said first-mentioned fasteners will not be seen when the frame assembly is secured to said wall structure at said opening.

6. The frame assembly of claim 5 wherein said outer frame is three sided and includes top and side parts of uniform cross section, said inner frame member being formed into corresponding top and side parts, said outturned wall of said outer frame adapted to extend at the top and side parts of the outer frame over the jambs and header of said wall structure at said opening when the frame assembly is inserted into said opening, a door hinged to one of said outer frame side parts.

7. The frame assembly of claim 3, wherein said opening is a window opening, said outer frame including longitudinal U-shaped channel parts enclosing a window glazing panel.

* * * * *